US006733356B2

(12) United States Patent
Lee

(10) Patent No.: US 6,733,356 B2
(45) Date of Patent: May 11, 2004

(54) FLYING-OBJECT LAUNCHING TOY GUN

(76) Inventor: Se-Yup Lee, Samik Apt., 1-708, 134-18, Cheongdam-dong, Kangnam-ku Seoul (KR), 135-100

( * ) Notice: Subject to any disclaimer, the term of this patent is extended or adjusted under 35 U.S.C. 154(b) by 36 days.

(21) Appl. No.: 10/181,985

(22) PCT Filed: Jan. 25, 2002

(86) PCT No.: PCT/KR02/00118

§ 371 (c)(1),
(2), (4) Date: Jul. 24, 2002

(87) PCT Pub. No.: WO02/070099

PCT Pub. Date: Sep. 12, 2002

(65) Prior Publication Data

US 2003/0134562 A1 Jul. 17, 2003

(30) Foreign Application Priority Data

Mar. 5, 2001 (KR) ..... 2001-11230
Nov. 6, 2001 (KR) ..... 2001-68809

(51) Int. Cl.[7] ..... A63H 1/60

(52) U.S. Cl. ..... 446/63; 446/236; 124/31; 124/16

(58) Field of Search ..... 446/34, 57, 63–65, 446/59, 60, 236, 489; 124/16, 26, 27, 31

(56) References Cited

U.S. PATENT DOCUMENTS 2,426,437 A * 8/1947 Cole et al. ..... 446/65
3,068,612 A * 12/1962 Simpson ..... 446/65
3,496,671 A * 2/1970 Korona ..... 446/50
3,918,197 A 11/1975 Stanzel
4,059,089 A 11/1977 Lehman
5,545,068 A 8/1996 Asbaghi
5,613,482 A 3/1997 Thai et al.

FOREIGN PATENT DOCUMENTS

JP 03-85096 8/1991

* cited by examiner

*Primary Examiner*—Jacob K. Ackun
*Assistant Examiner*—Bena Miller
(74) *Attorney, Agent, or Firm*—Lowe Hauptman Gilman & Berner LLP

(57) ABSTRACT

A flying-object launching toy gun comprises a body 20 with a launch barrel 30, a running block 50 for holding the flying-object 12 in a separable condition, the running block 50 movable along the launch barrel 30 between a rear pre-shooting position and a front post-shooting position, a loading knob 70 for bringing the running block 50 into the pre-shooting position, the loading knob 70 displaceable along the launch barrel 30, a coil spring 76 for causing the running block 50 to rapidly move from the pre-shooting position into the post-shooting position, and a spin generator 38, 56 for applying rotational force to the flying-object 12 as the running block 50 is caused to move from the pre-shooting position into the post-shooting position. The toy gun helps enable the flying-object to fly longer distance and prolonged time.

6 Claims, 5 Drawing Sheets

FLYING-OBJECT LAUNCHING TOY GUN

TECHNICAL FIELD

The present invention relates to a flying-object launching toy gun, and more particularly, to a flying-object launching toy gun which helps enable a flying-object to fly for a longer distance and prolonged time by using a gun-type launcher.

BACKGROUND ART

Infants and children take special interest in toys capable of making dynamic motions. Specifically, among these toys, a toy capable of causing a flying-object to fly by using propulsive force or only lift of air is one of toys which the children have the greatest preference for and simultaneously take the greatest interest in. Such a flying toy stimulates children's scientific curiosity and develops children's future-oriented thinking.

Since a toy capable of causing a flying-object to fly in the air by using only the lift of air, e.g. a toy capable of causing a flying saucer, a propeller-type flying-object or the like to fly, does not use additional propulsive force, there is a disadvantage in that the flying-object cannot be caused to fly for a long distance, or for a long time in spite of its long-distance flight. Therefore, if the flying-object can be made to fly for a longer distance and prolonged time, new interest will be aroused in the children.

DISCLOSURE OF INVENTION

It is an object of the present invention to provide a flying-object launching toy gun which helps enable a flying-object to fly for a longer distance and prolonged time so as to arouse children's interest.

According to the present invention, there is provided a flying-object launching toy gun, comprising a body with a launch barrel; a running block that holds a flying-object in a separable condition and is movable along the launch barrel of the body between a rear pre-shooting position and a front post-shooting position; a loading knob displaceable along the launch barrel for bringing the running block into the pre-shooting position; a launcher for causing the running block to move fast from the rear pre-shooting position to the front post-shooting position so that the flying-object can be launched forward; and a spin generator for applying rotational force to the flying-object as the running block is caused to move along the launch barrel.

BEST MODE FOR CARRYING OUT THE INVENTION

A preferred embodiment of a flying-object launching toy gun according to the present invention will now be described in detail with reference to the accompanying drawings.

Figure 1:
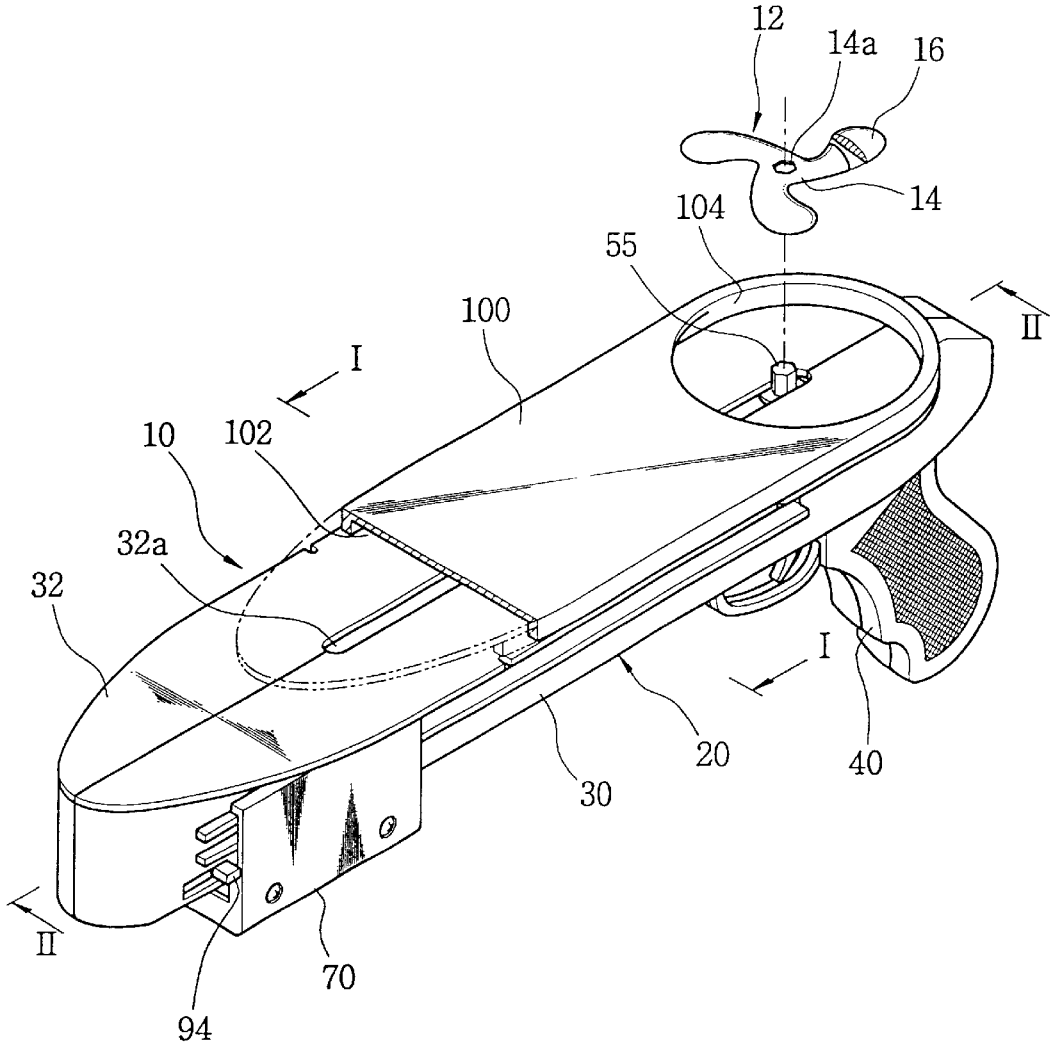
FIG. 1 is a perspective view showing an outer appearance of a flying-object launching toy gun according to the present invention.

First, it can be seen in FIG. 1 that a flying-object launching toy gun according to the invention generally comprises a launching unit 10 and a propeller-type flying-object 12 to be launched by the launching unit 10.

Figure 2:
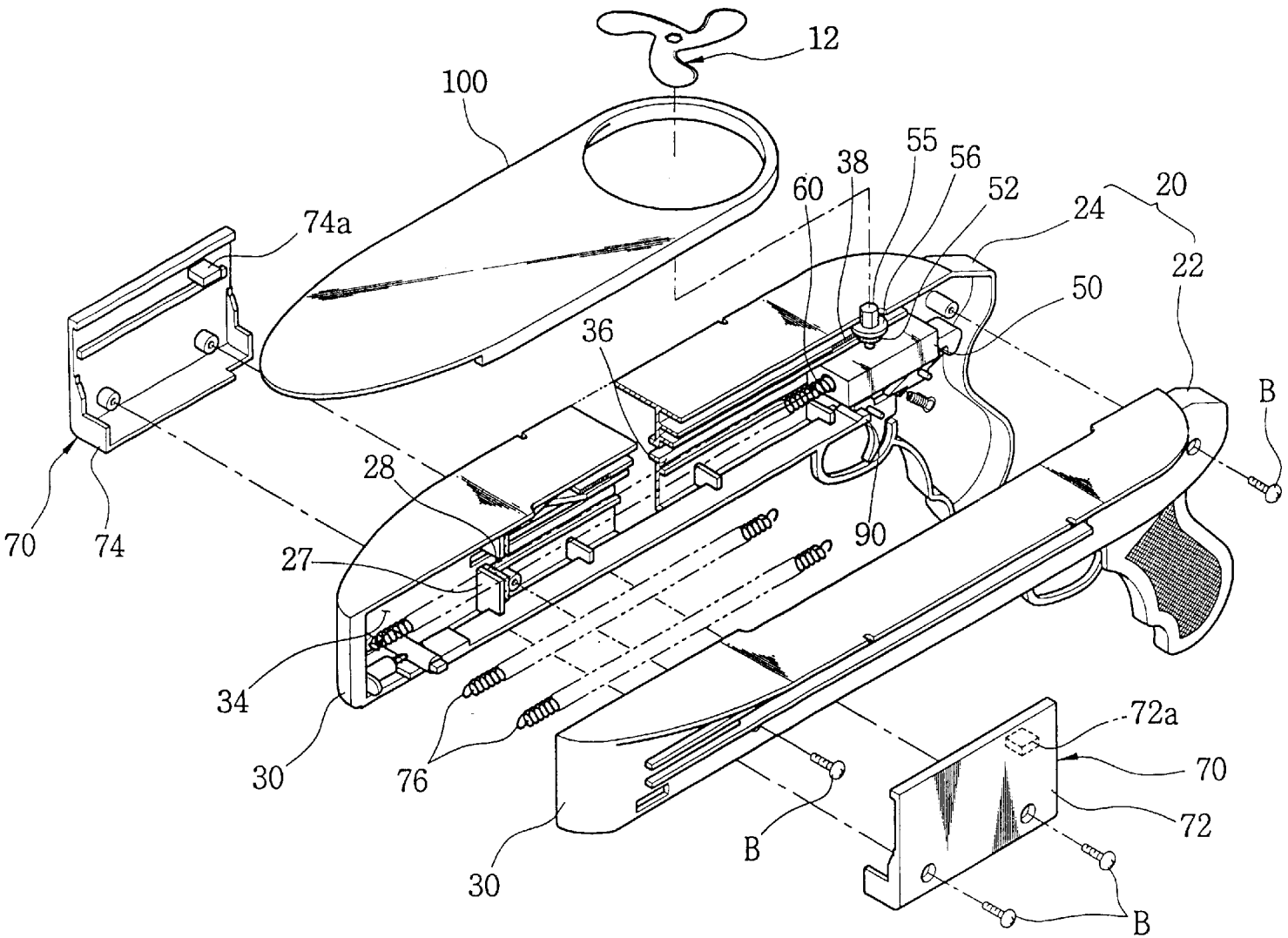
FIG. 2 is an exploded perspective view showing the constitution of the flying-object launching toy gun according to the present invention.

More specifically, the launching unit 10 has a body 20 that includes a left body half 22 and a right body half 24, which are separable from each other, as shown in FIG. 2. The separate left and right body halves 22, 24 can be assembled into the body 20 by using bolts or screws B so that they take the shape of a pistol.

Figure 3:
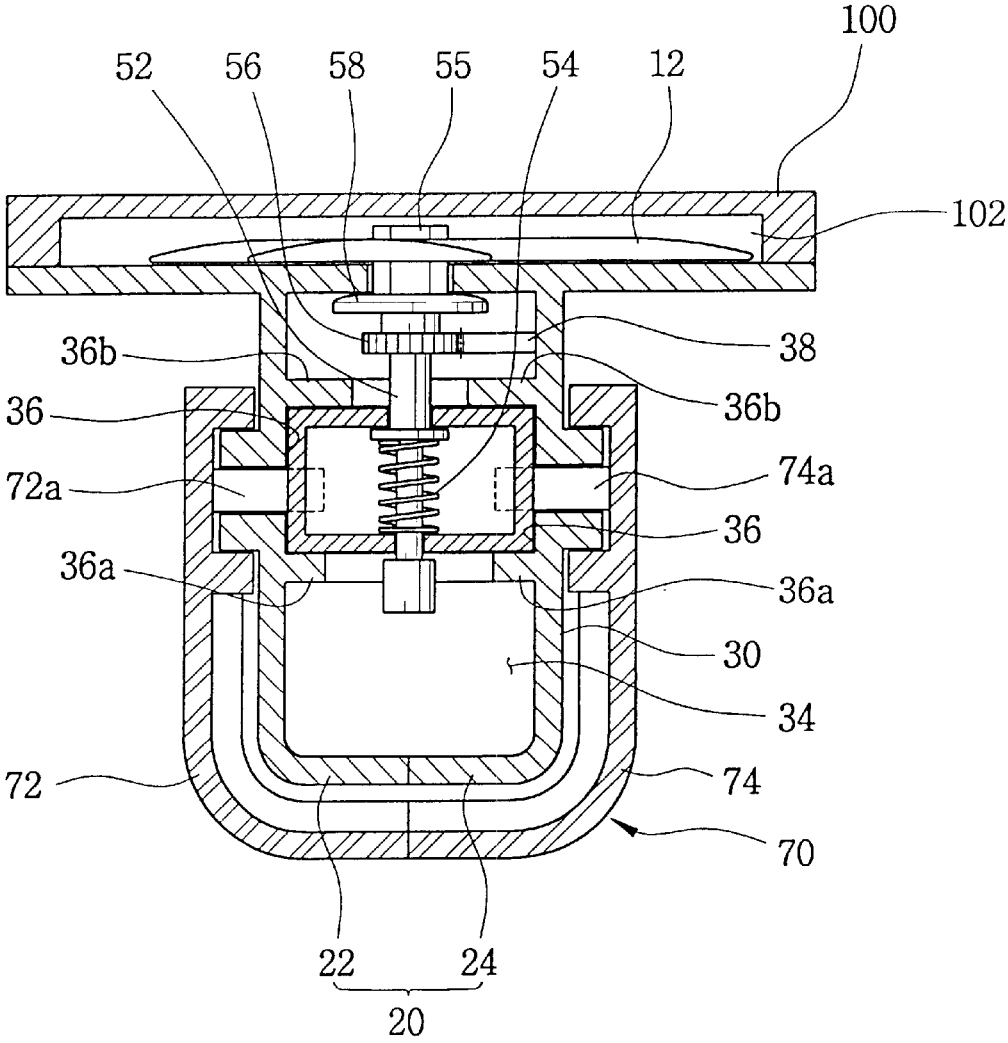
FIG. 3 is a sectional view taken along line I—I of FIG. 1.

Referring again to FIG. 1, the body 20 has a launch barrel 30 in the form of a gun barrel. A grip 40 is formed at one side of the launch barrel 30. Particularly, a wide slide surface 32 on which the flying-object 12 can slide is provided at the top of the launch barrel 30. As shown in FIGS. 2 and 3, an operation space 34 is also defined within the launch barrel. The operation space 34 is formed by assembling the left and right body halves 22, 24. Guide grooves 36 facing each other are formed at both lateral sides of the operation space, as shown in FIG. 3. At this time, the guide grooves 36 are constructed by pairs of lower and upper guide rails 36*a*, 36*b* longitudinally extending in parallel with and spaced apart from each other on inner surfaces of the left and right body halves 22, 24, respectively.

Further, a rack gear 38 is longitudinally formed along one of the inner surfaces of the left and right body halves defining the operation space 34. The rack gear 38 is shown as being installed on the inner surface of the right body half 24 throughout the drawings. Moreover, as shown in FIG. 1, a guide slot 32*a* is formed longitudinally on the slide surface 32 of the launch barrel 30 to communicate with the operation space 34 of the body 20.

Figure 4:
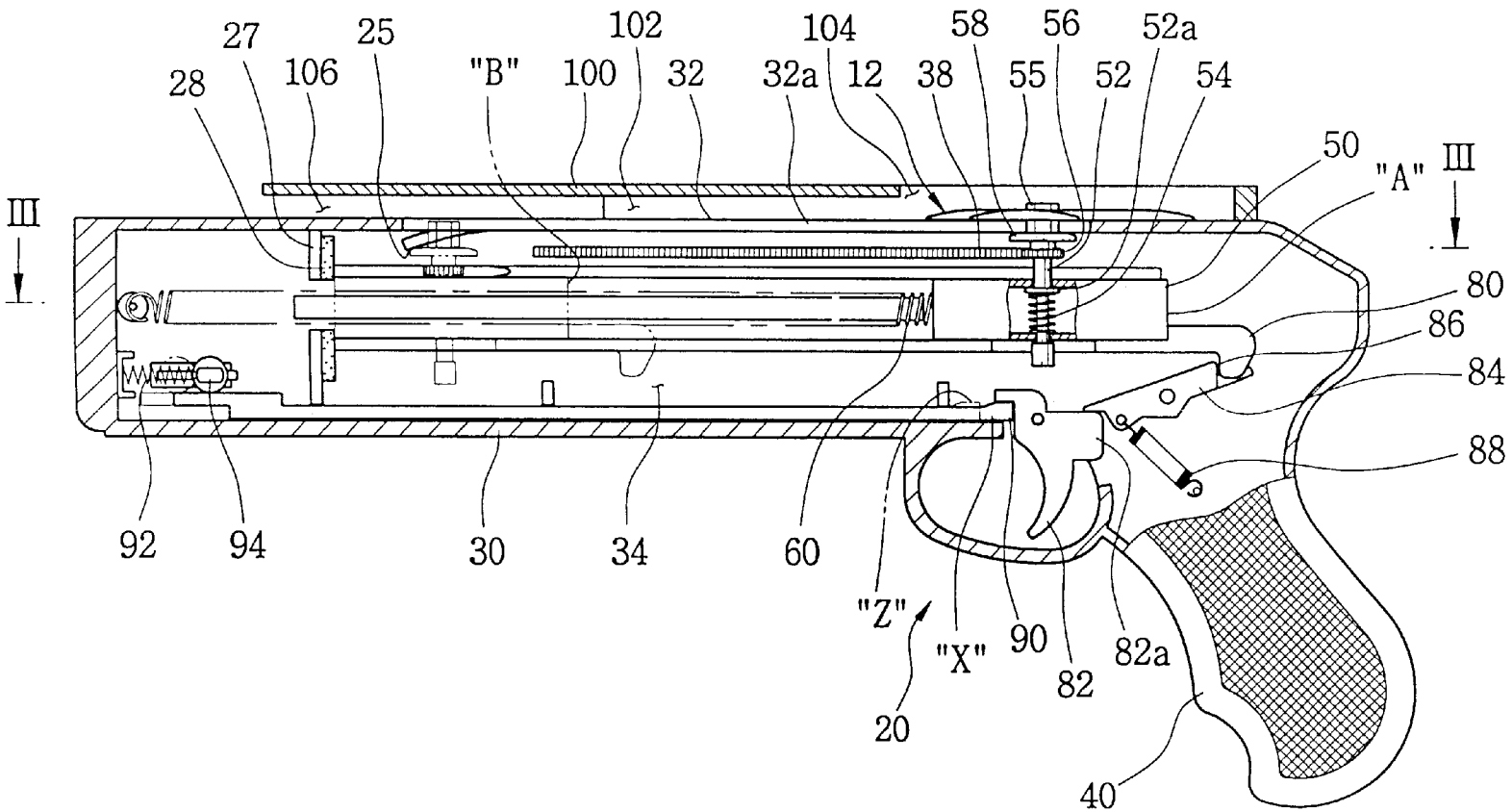
FIG. 4 is a sectional view taken along line II—II of FIG. 1.

Referring to FIG. 4, a running block 50 that can move along the guide grooves 36 between a rear pre-shooting position A and a front post-shooting position B is installed in the operation space 34 of the launch barrel 30. The running block 50 applies propulsive force to the flying-object 12, and has a rotational shaft 52 that can rotate about a vertical axis. The rotational shaft 52 vertically penetrates through the running block 50 in such a manner that both ends of the rotational shaft protrude beyond top and bottom surfaces of the running block 50. The rotational shaft 52 is constructed to move vertically along the vertical axis while being rotatable about the vertical axis. Further, although the rotational shaft 52 can move vertically along the vertical axis, it is resiliently supported and urged upward. To this end, a coil spring 54, which is fitted over the rotational shaft 52 and of which one end is supported by the running block 50 and the other end is supported by the rotational shaft 52 so as to resiliently urge the rotational shaft 52 upward, is disposed within the running block 50. That is, the rotational shaft 52 is constructed such that it can move axially in a state where it is resiliently urged upward. At this time, the rotational shaft 52 is formed with an outer annular extension 52*a* which is caught by the running block 50 in order to prevent the rotational shaft 52 urged upward from escaping from the running block 50.

In the meantime, the upper end of the rotational shaft 52 is formed with a coupling portion 55 below which a pinion gear 56 is formed. The coupling portion 55 is constructed such that the flying-object 12 is fitted over and coupled with the coupling portion, and that the coupling portion protrudes upward beyond the slide surface 32 through the guide slot 32*a* formed in the launch barrel 30. The coupling portion 55 will be described in detail later.

Figure 5:
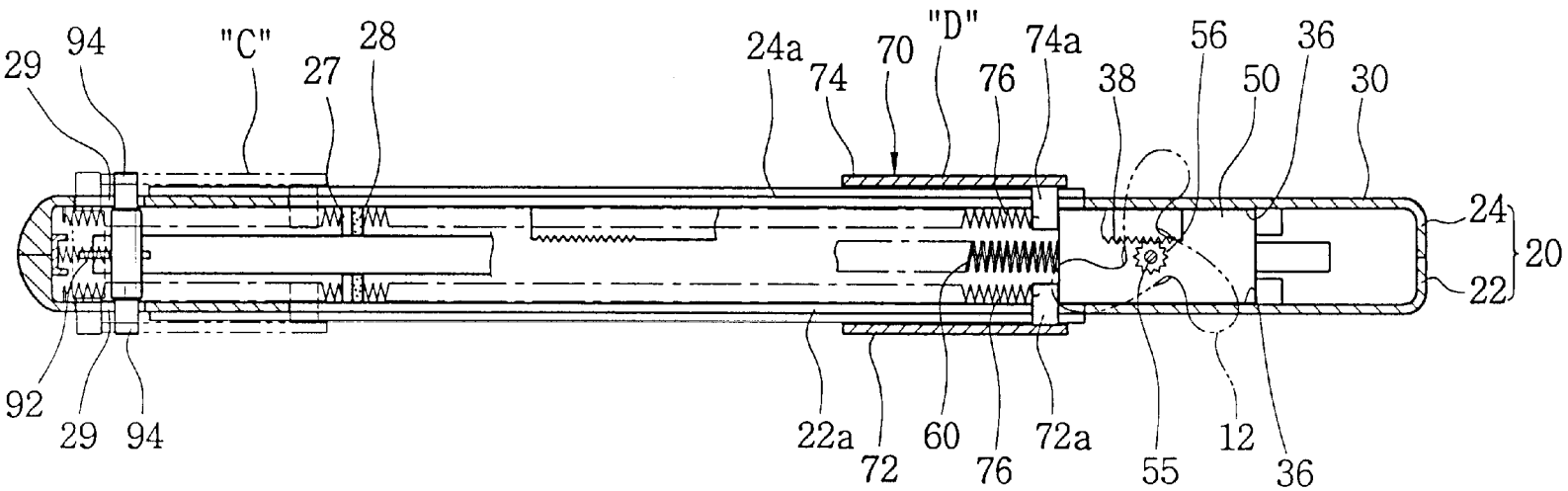
FIG. 5 is a sectional view taken along line III—III of FIG. 4.

The pinion gear 56 is configured to engage with the rack gear 38 formed at the one side of the operation space 34. As shown in FIG. 5, the pinion gear 56 is rotated while engaging with the rack gear 38 as the running block 50 is moved along the guide grooves 36, so that it can apply rotational force to the flying-object 12 fitted over the coupling portion 55 of the rotational shaft 52. As a result, the rack gear 38 and the pinion gear 56 serve as a spin generator for spinning the flying-object 12.

The running block 50 constructed as such is moved by resilient force from the rear pre-shooting position A into the front post-shooting position B by means of a resilient launcher, as shown in FIG. 4. This causes the flying-object 12 to fly forward of the launch barrel 30 by applying the propulsive force to the flying-object 12 mounted onto the running block. Such a resilient launcher can be comprised of a resilient body, e.g. a coil spring 60, one end of which is fixed to a front end of the launch barrel 30 and the other end of which is fixed to the running block 50. Of course, a rubber band or other type of launcher capable of generating the propulsive force may be used instead of the coil spring 60. For the sake of illustration, the use of the coil spring 60 having a high elastic strain will be explained hereinbelow by way of example.

The running block 50 serves to apply the propulsive force to the flying-object 12 mounted thereon while moving fast from the rear pre-shooting position A to the front post-shooting position B by means of the resilient launcher.

In the meantime, the rotational shaft 52 of the running block 50 is constructed to be lowered down at the moment the running block reaches a front end portion of the guide grooves 36 during the movement along the guide grooves 36. This causes the coupling portion 55 of the rotational shaft 52 over which the flying-object 12 is fitted, to easily escape and be separated from the flying-object 12. To this end, the flying-object launching toy gun according to the present invention further comprises a means for lowering the rotational shaft. As shown in FIG. 4, the rotational shaft lowering means includes a flange 58 formed around the rotational shaft 52, and an inclined projection 25 formed at a front portion of the body 20 to press down the flange 58 that is moved forward together with the rotational shaft 52. Such a rotational shaft lowering means serves to separate the coupled flying-object and coupling portion 55 of the rotational shaft 52 from each other by lowering the rotational shaft 52 through the pressing of the flange 58 moving to the front post-shooting position B with the inclined projection 25. Further, a front portion of the operation space 34 of the body 20 is formed with partitions 27. Shock absorbing pads 28 are attached to the partitions 27 and thus reduces the speed of the running block 50 that is resiliently moved from the rear pre-shooting position A to the front post-shooting position B and simultaneously prevents the running block from colliding with the body 20.

Referring again to FIGS. 2 and 5, the flying-object launching toy gun according to the present invention further comprises a loading knob 70 for bringing the running block 50 into the pre-shooting position A. The loading knob 70 includes a left knob half 72 and a right knob half 74, as shown in FIG. 2. The loading knob 70 into which the left and right knob halves 72, 74 are assembled by the bolts B is installed to be displaceable between a front standby position C and a rear loaded position D along the launch barrel 30, as shown in FIG. 5. Particularly, pressing pieces 72*a*, 74*a* are formed to protrude inward from inner surfaces of the left and right knob halves 72, 74 of the loading knob 70. The pressing pieces 72*a*, 74*a* penetrate through guide slots 22*a*, 24*a* formed to longitudinally extend along the left and right body halves 22, 24, respectively, and then protrude into the operation space 34 of the body 20. The pressing pieces 72*a*, 74*a* that have protruded into the operation space 34 can come into contact with and press a front surface of the running block 50. Accordingly, the pressing pieces 72*a*, 74*a* serves to bring the running block 50 from the post-shooting position B to the pre-shooting position A as the loading knob 70 is moved from the front standby position C to the rear loaded position D. Meanwhile, the loading knob 70 is constructed to be automatically returned to the standby position C after the running block 50 has been moved to the pre-shooting position A. To this end, coil springs 76 of which one ends are supported by the pressing pieces 72*a*, 74*a* of the loading knob 70, respectively, and the other ends are supported by a front end of the body 20 are installed within the operation space 34 of the body 20.

Moreover, the launching unit 10 of the flying-object launching toy gun according to the present invention further comprises a locking/unlocking means for locking the running block 50 that has been moved to the pre-shooting position A and for releasing the running block 50 from its locked state so that the running block 50 is allowed to move to the post-shooting position B. As shown in FIG. 4, the locking/unlocking means includes a catching hook 80 formed at a rear end of the running block 50, a trigger 82 installed at the body 20 to be pivotable on a hinge shaft, an extension piece 82*a* extending from a side portion of the trigger 82, a locker 84 installed at the body 20 to be rotatable through its interference with the extension piece 82*a*, a locking protrusion 86 for locking the running block 50 when caught by the catching hook 80 of the running block 50 placed in the pre-shooting position A, and a spring 88 for resiliently supporting the locker 84 in a direction for locking the running block 50. At this time, it is apparent that an upper surface of the locking protrusion 86 should be declined forward so that the catching hook 80 can ride over the locking protrusion as the catching hook is moved to the rear pre-shooting position A.

With such a constitution, when a user pulls the trigger 82 in a state where the running block 50 is secured in the pre-shooting position A, the extension piece 82*a* is pivoted and thence the locker 84 is also rotated so that the locking protrusion 86 is caused to be spaced apart from the catching hook 80 to unlock the running block. In such a state, the running block 50 resiliently supported by the coil spring 60 can be rapidly moved from the pre-shooting position A to the post-shooting position B. On the contrary, when the running block 50 is moved from the post-shooting position B to the pre-shooting position A in order to mount again the flying-object 12 onto the running block, the locking protrusion 86 of the locker 84 that is resiliently supported by the spring 88 allows the smooth movement of the running block 50 and is finally caught by the catching hook 80 to lock the running block 50 in the pre-shooting position A.

Moreover, the flying-object launching toy gun according to the present invention is provided with a trigger safety for limiting the shooting of the running block 50 that is locked in the pre-shooting position A. Particularly, the trigger safety is constructed to allow the pivoting of the trigger 82 only when the loading knob 70 is returned to the standby position C as shown in FIG. 5. As shown in FIG. 4, the trigger safety includes a stopper which is installed in the operation space 34 of the launch barrel 30 to reciprocate between a locking position X and a release position Z and restricts the pivoting of the trigger 82 in the locking position X, a spring 92 of which both ends are supported by the body 20 and the stopper 90, respectively, for resiliently urging the stopper 90 toward the locking position X, and unlocking pins 94 for causing the stopper 90 to move from the locking position X to the release position Z as the loading knob 70 moving to the standby position C presses the unlocking pins. Specifically, the stopper 90 lengthily extends from the front end of the body 20 up to the trigger 82, and the unlocking pins 94 are constructed to protrude from both sides of a front end of the stopper 90 and penetrate through and be exposed to the exterior of the body 20, as shown in FIG. 5. Of course, the body 20 is formed with slots 29 for allowing the unlocking pins 94 to move in a fore and aft direction.

Since such a trigger safety allows the pivoting of the trigger 82 only in a state where the loading knob 70 is returned to the standby position C, the flying-object 12 is beforehand prevented from being accidentally launched due to an erroneous operation of the user or impact exerted on the body 20.

Referring again to FIG. 1, it can be seen that a slide cover 100 is placed over the slide surface 32 of the launch barrel 30. The slide cover 100 guides the flying-object 12 mounted on the running block 50 toward the front portion of the launch barrel 30 and has a slide passage 102. Specifically, the slide passage 102 includes an upward open inlet 104 and a forward open outlet 106, as shown in FIG. 4. The slide cover 100 serves to guide the flying-object 12, which has been mounted through the inlet 104, to be launched through the outlet 106.

Meanwhile, as for the propeller-type flying-object 12 to be launched forward, the flying-object 12 has a main body 14 as shown in FIG. 1. The main body 14 is formed with a polygonal coupling hole 14*a* at the center thereof. The coupling portion 55 of the rotational shaft 52 of the running block 50 is fitted into the polygonal coupling hole 14*a*. At this time, it is apparent that the coupling portion 55 to be fitted in the coupling hole 14*a* also has a polygonal cross section corresponding thereto since the main body 14 of the flying-object 12 must be simultaneously spun upon rotation of the coupling portion 55. Here, since the coupling hole 14*a* and the coupling portion 55 should be separated from each other when the flying-object 12 is launched, it is preferred that the polygonal shape be a hexagonal shape for allowing a sufficient coupling force to be maintained, and at the same time, ensuring easy separation.

Further, a plurality of wings 16 are formed around the main body 14. The wings 16 are disposed at equiangular positions around the main body 14 and generate the lift as the main body 14 rotates. As for the wings 16, the number, angle and profile of the wings can be properly determined depending on uses of the flying-object 12, i.e. whether the flying-object 12 will be caused to fly for a longer distance or to a higher level. Particularly, by properly changing the angle of the wings, the flying-object 12 can have a boomerang function by which the launched flying-object 12 is returned back to a launching position. Meanwhile, the wings 16 should be constructed such that upper surfaces thereof are rounded widthwise. This is because of generation of the lift according to a Bernoulli's theorem.

Next, a use method of the flying-object launching toy gun constructed as such will be described with reference to FIGS. 1, 4 and 5. First, the running block 50 is moved from the post-shooting position B to the pre-shooting position A by using the loading knob 70. Then, the flying-object 12 is mounted onto the coupling portion 55 at the upper end of the rotational shaft 52 of the running block 50. At this time, it is apparent that the running block 50 is secured in the pre-shooting position A by means of the locker 84 of the locking/unlocking means and resiliently urged forward by means of the coil spring 60.

When the movement or loading of the running block 50 to the pre-shooting position A is completed, the loading knob 70 is caused to return to the standby position C. Then, the loading knob 70 presses the unlocking pins 94 of the trigger safety. As the unlocking pins 94 are pressed, the stopper 90 connected with the unlocking pins is moved from the locking position X to the release position Z so as to unlock the trigger.

In such a state, if the trigger 82 of the locking/unlocking means is pulled, the locking protrusion 86 of the locker 84 is spaced apart from the catching hook 80 of the running block 50. Accordingly, the running block 50 is unlocked to be resiliently moved from the pre-shooting position A to the post-shooting position B. At this time, the flying-object 12 mounted on the rotational shaft 52 is moved forward along the slide passage 102 of the slide cover 100 while obtaining the propulsive force by means of the running block 50, which is being resiliently moved forward, as well as the rotational force by means of the rack gear 38 and the pinion gear 56. Finally, the flying-object 12 is separated from the rotational shaft 52 of the running block 50 and then launched forward through the outlet 106 of the slide passage 102. Meanwhile, the rotational shaft 52 of the running block 50 is instantaneously lowered by the rotational shaft lowering means at the end of the process of the forward movement thereof. Consequently, the flying-object 12 can be easily separated from the coupling portion 55 of the rotational shaft 52 and then launched forward.

As described above, since the flying-object launching toy gun according to the present invention includes the spin generator and the running block moving along the launch barrel to apply the rotational force as well as the propulsive force to the mounted flying-object, it becomes possible to enable the flying-object to fly for a longer distance and prolonged time. As a result, there is an advantage in that it can attract children's attention and thus arouse the children's interest.

Although the present invention has been described by way of example with respect to the preferred embodiment, it is not limited thereto. Various changes and modifications may be made thereto within the scope of the invention defined by the appended claims.

What is claimed is:

1. A flying-object launching toy gun, comprising:

a body with a launch barrel;

a running block for holding a flying-object in a separable condition, said running block being movable along the launch barrel of the body between a rear pre-shooting position and a front post-shooting position;

a loading knob displaceable along the launch barrel for bringing the running block into the pre-shooting position;

a launcher for causing the running block to move from the rear pre-shooting position to the front post-shooting position so that the flying-object can be launched forward; and a spin generator for applying rotational force to the flying-object as the running block is caused to move along the launch barrel.

2. The flying-object launching toy gun as claimed in claim 1, wherein the launcher comprise a coil spring of which one end is fixed to a front end of the launch barrel and the other end is fixed to the running block.

3. The flying-object launching toy gun as claimed in claim 1, wherein the spin generator includes a rack gear installed longitudinally along the launch barrel, a pinion gear rotatably installed at the running block to engage with the rack gear, and a rotational shaft operably connected with the pinion gear to spin the mounted flying-object.

4. The flying-object launching toy gun as claimed in claim 1, further comprising a locking/unlocking means for locking the running block in the pre-shooting position and unlocking the running block so as to move toward the post-shooting position, wherein the locking/unlocking means includes a trigger installed at the body for pivotal movement about a hinge shaft, a locker operably connected with the trigger and having a locking protrusion, a catching hook formed on the running block to catch the locking protrusion of the locker, and a spring for resiliently urging the locker in such a direction as to cause the locking protrusion to be caught by the catching hook.

5. The flying-object launching toy gun as claimed in claim 4, further comprising a trigger safety for selectively limiting the unlocking of the running block that is locked in the pre-shooting position, wherein the trigger safety includes a stopper installed in the launch barrel for reciprocating movement between a locking position in which the movement of the trigger is restricted and a release position in which the trigger is allowed to move, a spring for resiliently urging the stopper toward the locking position, and unlocking pins for causing the stopper to move from the locking position to the release position as the loading knob presses the unlocking pins.

6. The flying-object launching toy gun as claimed in claim 1, wherein the body is of a pistol shape.

* * * * *